US006528461B1

(12) United States Patent
Mike et al.

(10) Patent No.: US 6,528,461 B1
(45) Date of Patent: Mar. 4, 2003

(54) LUBRICANT CONTAINING MOLYBDENUM AND POLYMERIC DISPERSANT

(75) Inventors: Carl A. Mike, Richmond, VA (US); Carl K. Esche, Richmond, VA (US); Mark T. Devlin, Richmond, VA (US)

(73) Assignee: Bank of America, N.A., San Francisco, CA (US)

( * ) Notice: Subject to any disclaimer, the term of this patent is extended or adjusted under 35 U.S.C. 154(b) by 0 days.

(21) Appl. No.: 09/723,779

(22) Filed: Nov. 28, 2000

(51) Int. Cl.[7] ..... C10M 135/18; C10M 149/06
(52) U.S. Cl. ..... 508/287; 508/364
(58) Field of Search ..... 508/287, 364

(56) References Cited

U.S. PATENT DOCUMENTS

| | | | | | |
|---|---|---|---|---|---|
| 3,578,690 | A | | 5/1971 | Becker | 260/414 |
| 4,098,705 | A | * | 7/1978 | Sakurai et al. | 252/33.6 |
| 4,176,073 | A | | 11/1979 | Ryer et al. | 252/32.7 E |
| 4,176,074 | A | | 11/1979 | Coupland et al. | 252/32.7 E |
| 4,266,945 | A | | 5/1981 | Karn | 44/68 |
| 4,324,672 | A | | 4/1982 | Levine et al. | 252/49.7 |
| 4,765,918 | A | | 8/1988 | Love et al. | 252/46.4 |
| 4,824,611 | A | | 4/1989 | Cells | 260/414 |
| 4,889,647 | A | | 12/1989 | Rowan et al. | 252/42.7 |
| 4,952,637 | A | | 8/1990 | Kapuscinski et al. | 525/279 |
| 5,075,383 | A | | 12/1991 | Migdal et al. | 525/293 |
| 5,137,647 | A | | 8/1992 | Karol | 252/33.6 |
| 5,266,223 | A | | 11/1993 | Song et al. | 252/51.5 A |
| 5,350,532 | A | | 9/1994 | Song et al. | 252/49.6 |
| 5,356,547 | A | * | 10/1994 | Arai et al. | 508/364 |
| 5,356,999 | A | | 10/1994 | Kapuscinski et al. | 525/286 |
| 5,374,364 | A | | 12/1994 | Kapuscinski et al. | 252/47 |
| 5,424,366 | A | | 6/1995 | Kapuscinski et al. | 525/279 |
| 5,435,926 | A | | 7/1995 | Gutierrez et al. | 252/51.5 A |
| 5,578,237 | A | | 11/1996 | Emert et al. | 508/454 |
| 5,614,124 | A | | 3/1997 | Esche, Jr. et al. | 508/251 |
| 5,650,380 | A | | 7/1997 | Fletcher | 508/168 |
| 5,650,381 | A | | 7/1997 | Gatto et al. | 508/364 |
| 5,672,572 | A | * | 9/1997 | Arai et al. | 508/364 |
| 5,736,491 | A | | 4/1998 | Patel et al. | 508/365 |
| 5,744,430 | A | | 4/1998 | Inoue et al. | 508/295 |
| 5,759,967 | A | | 6/1998 | Song et al. | |
| 5,763,369 | A | | 6/1998 | Baumgart et al. | 508/183 |
| 5,789,355 | A | * | 8/1998 | Adams et al. | 508/241 |
| 5,895,779 | A | | 4/1999 | Boffa | |
| 5,916,851 | A | * | 6/1999 | Hosonuma et al. | 508/363 |
| 5,942,475 | A | | 8/1999 | Schlosberg et al. | 508/492 |
| 5,965,497 | A | * | 10/1999 | Adams et al. | 508/287 |
| 6,034,038 | A | | 3/2000 | Lockwood et al. | 508/183 |
| 6,051,537 | A | | 4/2000 | Emert et al. | 508/469 |
| 6,103,673 | A | | 8/2000 | Sumiejski et al. | 508/186 |
| 6,103,674 | A | | 8/2000 | Nalesnik et al. | 508/334 |
| 6,107,258 | A | | 8/2000 | Esche, Jr. et al. | 508/231 |
| 6,117,825 | A | | 9/2000 | Liu et al. | 508/291 |
| 6,140,279 | A | * | 10/2000 | Emert et al. | 508/192 |
| 6,245,725 | B1 | * | 6/2001 | Tanaka et al. | 508/365 |

FOREIGN PATENT DOCUMENTS

| | | | |
|---|---|---|---|
| EP | 0 909 805 | A1 | 4/1999 |
| WO | WO96/06904 | A1 | 3/1996 |
| WO | WO99/60080 | A1 | 11/1999 |
| WO | WO01/46352 | A1 | 6/2001 |
| WO | WO01/49761 | A1 | 7/2001 |

OTHER PUBLICATIONS

The Ilsac GF–3 Minimum Performance Standard For Passenger Car Engine Oils (General Motors Corp., Ford Motor Co., DaimlerChrysler Corp., Japan Automobile Manufacturers Association, Inc., and Engine Manufacturers Association, Inc.—Oct. 12, 2000).

* cited by examiner

*Primary Examiner*—Ellen M. McAvoy

(57) ABSTRACT

The boundary friction properties of lubricating oils are improved by including at least one polymeric ethylene-alpha-olefin copolymer derived dispersant and a molybdenum compound into a lubricating oil of a lubricating viscosity. A concentrate for addition into an oil of lubricating viscosity is also disclosed.

13 Claims, No Drawings

LUBRICANT CONTAINING MOLYBDENUM AND POLYMERIC DISPERSANT

TECHNICAL FIELD

This invention relates to engine oil lubricants and engine oil lubricant concentrates having enhanced frictional properties and improved fuel economy, methods for their preparation, and their use. The lubricating oil compositions of this invention are particularly useful as crankcase lubricants.

BACKGROUND OF THE INVENTION

An automotive crankcase is subjected to well known extremes of heat and friction which cause engine oil breakdown, as well as contribute to the presence of contaminants including dirt, soot, water and other particulate matter.

This environment results in the oil suffering oxidation that is catalyzed by the presence of impurities in the oil such as iron compounds, and the oxidation is enhanced by the elevated temperatures endured during engine use.

Various engine oil additives are known for improving the internal operating condition of an engine, including antiwear agents, antioxidants, friction modifiers, detergents, and dispersants. Each may improve the oil through controlling any of various degradations suffered during use.

The additives may be added to the fuel composition, the engine oil, or other lubricants and greases as appropriate, be they synthetic or natural.

Dispersants of various forms are known. These are primarily additives for lubricating oils, which function at low operating temperatures to prevent or retard the formation of sludge, and also to solubilize the sludges which are formed. In structure, most dispersants have a polar and nonpolar portion. The nonpolar portion is frequently a polybutene, and the polar portion contains amino groups.

The industry trend is to provide ashless dispersants, i.e., without metal.

Succinimide dispersants are well known, they are typically based on polybutene (900–3000 Mn) adducts of maleic anhydride reacted with various polyamines, e.g. tetraethylene pentamine or triethylene tetramine. Bis-succinimides are generally preferred over monosuccinimides, even though product viscosities are higher. Succinate esters, based on polybutene adducts that are esterified with polyols, e.g. pentaerythritol, are also known.

Mannich base products consisting of condensation products from polybutene alkylphenol, formaldehyde, and polyamines are also known.

Alkenyl-substituted succinic anhydrides derived dispersants are well known. Such alkenyl-substituted succinic anhydrides are typically prepared by a thermal process (see, e.g., U.S. Pat. No. 3,361,673), or a mixed thermal/chlorination process (see, e.g., U.S. Pat. No. 3,172,892). The polyisobutenyl succinic anhydrides ("PIBSA") include monomeric adducts (see, e.g., U.S. Pat. Nos. 3,219,666; 3,381,022) and products adducted with at least 1.3 succinic groups per polyalkenyl-derived substituent (see, e.g., U.S. Pat. No. 4,234,435 to Meinhardt).

PIBSA serves as a ubiquitous precursor to several crankcase ashless dispersants, including succinimides, succinates, succinate esters amides, and triazoles (U.S. Pat. Nos. 3,272,746; 4,234,435; 3,219,666; 4,873,009; 4,908,145; and 5,080,815). In the formation of succinimides, the PIBSA is reacted with a polyamine to form a structurally complex mixture that may contain imide, amide, and imidazoline and diamide groups.

The above-mentioned Mannich base dispersants represent another known class of crankcase dispersants (e.g. HiTEC® 7049 dispersant, available from Ethyl Corporation, of Richmond, Va.). These compounds are typically produced by reacting alkyl-substituted phenols with aldehydes and amines, such as is described in U.S. Pat. Nos. 3,539,633; 3,697,574; 3,704,308; 3,736,535; 3,736,357; 4,334,085; and 5,433,875.

Also known are functionalized olefin copolymers and their use as additives in fuel and lubricating oil compositions, as described in U.S. Pat. No. 6,107,258, which describes a cross linked low molecular weight ethylene-propylene succinic anhydride dispersant. The functionalized olefin copolymers disclosed therein include an olefin copolymer on which has been grafted an ethylenically unsaturated carboxylic acid, or derivative thereof, to form an acylated olefin copolymer containing reactive carboxylic functionality. The acylated olefin copolymer is then reacted with a coupling compound, which contains more than one amine, thiol and/or hydroxy functionality capable of reacting with the carboxylic functionality of preferably more than one acylated olefin copolymer.

Additionally, the acylated olefin copolymers, either before or after reaction with the coupling compound, are reacted with a performance enhancing compound or compounds, i.e., compounds containing only one functional group capable of reacting with the carboxylic functionality of the acylated olefin copolymer, in order to obtain further benefits such as improved antioxidancy, antiwear and additional dispersancy properties.

Molybdenum is a well-known wear inhibitor (friction modifier), and available commercially in many forms.

Molybdenum carboxylate salts are known to increase fuel economy. Various organo molybdenum compounds are available for inclusion in a lubricating oil, including molybdenum ditridecyldithiocarbonate, and others.

U.S. Pat. No. 3,144,712 discloses oil-soluble molybdenum additives useful in lubricating oils such as molybdates of organic nitrogen bases.

Molybdenum dialkyldithiocarbamates are described in U.S. Pat. Nos. 4,098,705; 4,846,983; 5,916,851; 3,356,702; 3,509,051; and 4,098,705.

U.S. Pat. No. 4,176,074 to Coupland discloses molybdenum complexes of ashless oxazoline dispersants as friction reducing antiwear additives for lubricating oils.

U.S. Pat. No. 4,266,945 to Karn discloses molybdenum containing compositions prepared by reacting an acid or salt of molybdenum, a phenol or reaction product of a phenol and at least one lower aldehyde, and an amine, condensation product of an amine, and salts of an amine or condensation product of an amine.

U.S. Pat. No. 4,324,672 to Levine discloses molybdenum derivatives of high molecular weight alkenylsuccinimides.

U.S. Pat. No. 5,650,380 to Fletcher discloses a lubricating composition including a base oil of mineral or synthetic in origin in combination with molybdenum disulfide, zinc naphthenate, and one or more metal dithiophosphates, with optionally one or more metal dithiocarbamates.

U.S. Pat. No. 5,650,381 to Gatto et al. discloses a lubricating oil composition comprising a molybdenum compound which is substantially free of active sulfur and a secondary diarylamine. This combination is said to provide improved oxidation control and friction modifier performance to the lubricating oil.

U.S. Pat. No. 5,736,491 to Patel discloses improving fuel economy characteristics of a lubricant by friction reduction by mixing the lubricant with a C2 to C12 aliphatic carboxylate salt of molybdenum and a zinc dialkyldithiophosphate or zinc dialkyldithiocarbamate.

U.S. Pat. No. 5,744,430 to Inoue et al. discloses, with certain limiting conditions, a base oil with an alkaline earth metal salicylate detergent, a zinc dialkyldithiophosphate, a succinimide ashless dispersant containing a polybutenyl group, a phenol ashless antioxidant, a molybdenum dithiocarbamate friction modifier, and a viscosity index improver.

Molybdenum containing additives are known to deliver a variety of beneficial properties to lubricants. Examples of lubricants that benefit from the addition of molybdenum include passenger car motor oils, natural gas engine oils, heavy duty diesel oils, and railroad oils. Over the years, when used properly, molybdenum has been shown to deliver improved anti-wear protection, improved oxidation control, improved deposit control, and improved friction modification for fuel economy.

The prior art is replete with examples showing the use of molybdenum as antioxidants, deposit control additives, antiwear additives, and friction modifiers. Some of these include U.S. Pat. Nos. 4,360,438; 4,501,678; 4,529,526; 4,692,256; 4,705,641; 4,812,246; 4,832,867; 5,458,807; 5,605,880; 5,650,381; 5,658,862; 5,665,684; 5,688,748; 5,696,065; 5,736,491; 5,763,369; 5,786,307; 5,807,813; 5,814,587; 5,837,657; 5,840,672; 5,880,073; 6,034,038; 6,051,537; 6,103,673; and 6,103,674 PCT Application Nos. WO95/07966; WO95/07964; WO95/07963; WO95/27022; WO95/07961; and European Patent Applications No. 0447 916 A1 and 0 768 366 A1.

Numerous oil-soluble molybdenum compounds and their methods of preparation have been described in the art. For example, glycol molybdate complexes are described in U.S. Pat. No. 3,285,942, overbased alkali metal and alkaline earth metal sulfonates, phenates, and salicylate compositions are disclosed in U.S. Pat. No. 4,832,857, molybdenum complexes prepared by reacting a fatty oil, a diethanolamine and a molbydenum source are disclosed in U.S. Pat. No. 4,889,647; a sulfur and phosphorus free organomolybdenum complex of organic amide are taught in U.S. Pat. No. 5,137,647; overbased molybdenum complexes prepared from amines, diamines, alkoxylated amines, glycols, and polyols is described in U.S. Pat. No. 5,143,633; and 2,4-heteroatom substituted-molybdena-3,3-dioxacycloalkanes are described in U.S. Pat. No. 5,412,130.

While there are myriad lubricating agents which may be classified as antiwear, antifriction, or extreme pressure agents, each may act in a completely different physical manner or chemical manner and often may compete with one another for sites on the metal surface of the moving part. Accordingly, extreme care must be exercised in the selection of additives to ensure compatibility and effectiveness.

SUMMARY OF THE INVENTION

While various oil additives can improve individual properties of a lubricating oil, it is desirable to achieve the most improvement with the least cost. Accordingly, applicants have developed a novel lubricating oil composition, which surprisingly improves the effectiveness of a molybdenum-containing friction modifier.

Unexpectedly, it has now been discovered that the choice of dispersant can improve the effectiveness of a molybdenum-containing friction modifier.

More specifically, a polymeric ethylene α-olefin dispersant acts synergistically with molybdenum compounds to reduce friction in a lubricating oil system.

Thus, in one aspect, this invention is directed to a lubricating oil composition comprising (i) a major amount of a lubrication oil, (ii) an oil soluble molybdenum compound, and (iii) an ethylene-alpha-olefin derived copolymeric dispersant.

In another aspect, the invention is directed to the reduction of friction of a lubricant by incorporating a molybdenum compound and a polymeric dispersant into a base oil.

The present invention is also directed to motor vehicles and/or an engine lubricated with a lubricating oil composition as follows. The motor vehicle or engine may be a gasoline or diesel engine, and is lubricated with a composition including a lubricating oil of lubricating viscosity, a molybdenum-containing compound, and an ethylene-alpha-olefin derived copolymer dispersant.

In yet another aspect, the invention is directed to the production of a concentrate for addition to a base oil for the reduction of friction, including a polymeric ethylene-propylene copolymer dispersant and a source of molybdenum, in amounts effective to reduce friction of the finished oil composition.

DETAILED DESCRIPTION

The reduction in the quantity and number of different additives in a lubricating oil composition is desirable for cost and environmental reasons or both. Furthermore, increases in fuel economy are likewise desirable for not only emissions reduction purposes, but also for preservation of scarce natural resources.

However, the two objects can frequently be in conflict as improvements most commonly are achieved by adding additional components to a lubricating or fuel composition.

The less of an additive which needs to be included in a composition, the lower the cost, which savings can be then passed along to the consumer in the form of lower prices. Additionally, the emissions from internal-combustion engines are a matter of constantly growing concern, and improvements in performance through synergies can result in a reduction of emissions by the expedient inclusion of fewer compounds.

Applicants have discovered what appears to be a synergy between polymeric dispersants and molybdenum compounds, which results in unexpectedly superior reduction in the coefficient of friction within an internal combustion engine.

Accordingly, in the preferred embodiment of the present invention, there is provided a lubricating oil composition which includes at least the following components:

a) oil of lubricating viscosity b) a polymeric dispersant derived from an ethylene-α-olefin copolymer, and c) a molybdenum compound.

The lubricant is in one embodiment a Group II or higher oil, and the polymeric dispersant is most preferably a succinimide derived from an acylated ethylene-propylene copolymer.

In yet another embodiment, the succinimide is derived from an aromatic amine, such as that disclosed in U.S. Pat. No. 5,135,671 (n-phenyl p-phenylene diamine).

A composition according to the present invention lowers the boundary friction coefficient and improves fuel economy in engines lubricated with said composition.

Other embodiments of this invention will become apparent from a consideration of the ensuing description and appended claims.

The percentages by weight of the dispersant additives noted in the specification and claims of this invention are on an oil free basis unless otherwise noted. For example, when an oil composition of the invention is described as containing at least 1% by weight of a dispersant additive, the oil comprises at least 1% by weight of the dispersant additive on an oil free basis. Thus, if the dispersant additive were available as a 40% by weight solution in oil, the oil composition would include at least 2.5% by weight of this dispersant oil solution.

BASE OIL

The lubrication oil component of this invention may be selected from any of the synthetic or natural oils or mixtures thereof used as lubricants such as that for crankcase lubrication oils for spark-ignited and compression-ignited internal combustion engines, for example automobile and truck engines, marine, and railroad diesel engines. Synthetic base oils include alkyl esters of dicarboxylic acids, polyglycols and alcohols, poly-alpha-olefins, including, inter alia, polybutenes, alkyl benzenes, organic esters of phosphoric acids, and polysilicone oils.

Natural base oils include mineral lubrication oils which may vary widely as to their crude source, e.g., as to whether they are paraffinic, naphthenic, or mixed paraffinic-naphthenic.

The lubrication oil base stock conveniently has a viscosity of about 2.5 to about 15 cSt ($mm^2/s$) and preferably about 2.5 to about 11 cSt ($mm^2/s$) at 100° C.

Suitable base stock oil includes Group I, II, III, and IV base oils, as are known to those of skill in the art. In certain instances, usually depending on the final use of the lubricant composition according to the present invention, Group I is preferred, and in other instances, Group II and III are preferred.

Group I base stocks contain less than 90% saturates (as determined by ASTM D 2007) and/or greater than 0.03 percent sulfur (as determined by ASTM D 2622, D4294, D 4927, or D 3120) and have a viscosity index greater than or equal to 80 and less than 120 (as determined by ASTM D 2270).

Group II base stocks contain greater than or equal to 90% saturates and less than or equal to 0.03% sulfur and have a viscosity index greater than 80 and less than 120 using the above noted test methods. Group II+oils may also be used. These are oils which have a VI at the high end of the VI spectrum, e.g. about 120.

Group III base stocks contain greater than or equal to 90 percent saturates and less than or equal to 0.03% sulfur and have a viscosity index greater than or equal to 120 using the tests noted above.

Group IV base stocks are polyalphaolefins (PAO).

MOLYBDENUM COMPOUNDS

Suitable molybdenum compounds include those derived from carboxylic acids, carboxylic acid amides or fatty acid amides, as described in U.S. Pat. Nos. 3,578,690, 4,765,918, 4,889,647, 5,137,647.

Some commercially available molybdenum compounds derived from carboxylic acids that are suitable for use in the present invention include 15% Molybdenum HEX-CEM, available from OM Group, Inc.; Molybdenyl naphthenate 6%, and molybdenum octoate 8%, a molybdenum 2-ethylhexanoate available from Shepherd Chemical Company of Cincinnati, Ohio.

Molybdenum HEX-CEM™ is supplied by the OM Group, Inc., of Cleveland, Ohio, and is a molybdenum 2-ethylhexanoate.

Further examples of suitable commercial molybdenum compounds derived from organic amides include Molyvan® 807, a 50 wt % molybdenum ditridecyldithiocarbonate containing about 50 wt % of an aromatic oil having a specific gravity of about 38.4 SUS and containing about 4.6 wt % molybdenum; Molyvan® 855 (a sulfur and phosphorus free decomposable organo molybdenum friction modifier which is an organomolybdenum complex of organic amide); Molyvan® 856B, also an organomolybdenum complex; Molyvan® 822 (a sulfur-containing molybdenum friction modifier); Molyvan®-A, which nominally contains 28.8 wt % Mo, 31.6 wt. % C, 5.4 wt % H, and 25.9 wt % S; Molyvan®-L, and sulfonated oxymolybdenum dialkyldithiophosphate (U.S. Pat. No. 5,055,174) each available from R.T. Vanderbilt Company, Inc., Norwalk, Conn.

Also commercially available is SAKURA LUBE® 500, a soluble Molybdenum dithiocarbamate and amine containing lubricant, containing 20.2 wt % Mo, 43.8 wt % C, 7.4 wt % H, and 22.4 wt % S, from Asahi Denki Corp, Tokyo, Japan.

Molybdenum carboxylate salts combined with zinc dialkyldiothiophosphates are described in U.S. Pat. No. 5,736,491, while other molybdenum compounds are described in U.S. Pat. Nos. 4,824,611; 4,633,001; 3,595,891.

Molybdenum dialkyldithiocarbamates are described in U.S. Pat. Nos. 4,098,705; 4,846,983; 5,916,851; 3,356,702; 3,509,051; and 4,098,705.

Examples of commercial molybdenum dialkyl dithiocarbamates that may be used include Molyvan® 807 and Molyvan® 822, also available from R.T. Vanderbilt Company, Inc., Norwalk, Conn., and Sakura-Lube® 100, Sakura Lube® 155; Sakura Lube® 165, and Sakura Lube® 600, available from Asahi-Denka KK, Tokyo, Japan.

The amount of molybdenum added to the finished oil will vary depending on the customer requirement and the specific application. Treat levels may vary, by way of example and not of limitation, from about 50 to about 1500 ppm, preferably from 100 to 450 ppm, more preferably from about 100 to 250, and particularly about 125 to 250 ppm, and are generally dependent upon the performance requirements of the finished oil. However, any amount of the inventive components sufficient to achieve the unexpected but desirable synergy is within the scope of this invention.

The actual amount of molybdenum added is based upon the final molybdenum level desired in the lubricating composition. Thus, the quantity of additive will be tailored based upon active amounts of molybdenum required to form the final, finished oil having the beneficial properties. If the molybdenum is supplied in a concentrated form for later inclusion into a finished oil, the active amount of molybdenum in the concentrate should be tailored to supply the correct amount of active molybdenum in the final finished oil based upon a selected treat rate for the concentrate in the finished oil.

By "active" molybdenum is meant the delivered elemental molybdenum from the molybdenum containing composition.

The molybdenum should be supplied in an amount effective to reduce the coefficient of friction in a synergistic manner with the ethylene-α olefin polymeric dispersant.

Generally speaking, this is an amount of at least about 50 ppm, preferably at least about 100 ppm, more preferably at least 200 ppm, up to about about 1600 ppm, preferably up to about 800 ppm, more preferably up to about 500 ppm. The molybdenum may also beneficially provide an antioxidant effect.

In terms of fully formulated oil compositions, the invention is especially effective in formulating oils which meet the ILSAC GF-3 passenger car motor oil standard, published Oct. 12, 2000 by the International Lubricant Standardization and Approval Committee, which is incorporated herein by reference.

POLYMERIC DISPERSANTS

Commercially available dispersants are suitable for use in the present invention. For example, HiTEC® 1910 dispersant, an ethylene-propylene dispersant, manufactured by Ethyl Corporation, Richmond, Va. is especially preferred for use in the present invention. HiTEC® 1910 dispersant is an ethylene-propylene copolymer grafted with maleic anhydride and reacted with n-phenyl phenylene diamine.

Low molecular weight ethylene-α-olefin succinic anhydride dispersants, as described in U.S. Pat. Nos. 5,075,383 and 6,117,825 is also suitable for use in the present invention. An example of a commercially available low molecular weight ethylene-propylene succinic anhydride dispersant (LEPSAD) is HiTEC® 1910 dispersant, available from Ethyl Corporation, Richmond, Va.

Also suitable in the present invention are ethylene alpha-olefin polymers as described in U.S. Pat. Nos. 5,266,223; 5,350,532; and 5,435,926. Ethylene-propylene diene polymers, such as those described in U.S. Pat. Nos. 4,952,637, 5,356,999, 5,374,364, and 5,424,366 are also suitable.

A cross-linked low molecular weight ethylene-propylene succinic anhydride dispersant is also suitable for use in the present invention. These cross-linked dispersants are similar to the low molecular weight ethylene α-olefin succinic anhydride dispersants discussed above, but additionally contain a multifunctional polyamine to achieve advantageous cross linking, as described in U.S. Pat. No. 6,107,258.

Suitable dispersants will be derived from ethylene-alpha-olefin polymers having a molecular weight of between about 300 and about 25,000, preferably from about 1000 to about 15,000; more preferably from about 5,000 to about 15,000.

The dispersants according to the present invention can be incorporated into the base stocks of the finished oil, or into a concentrate.

Given the synergy between the molybdenum compound and the polymeric dispersant, effective amounts of the dispersant in the finished oil can have a wide range, from about 0.001 to about 5.0 weight %, and preferably from about 0.005 to about 3.5 weight %, more preferably from about 0.1 to about 1.0 weight %, based upon the total weight of the composition.

In concentrates intended for dilution into a finished oil product, the amount would be proportionately higher.

MOLYBDENUM/DISPERSANT COMBINATION

The ratio of molybdenum to dispersant can vary widely based upon the end use of the finished oil product. However, it is presently preferred that the ratio of molybdenum to ethylene-apha-olefin dispersant is from about 0.01 to about 0.4 parts by weight of molybdenum per part of dispersant, based upon active molybdenum. Preferably, the ratio of molybdenum (active) to dispersant is from about 0.02 to about 0.2.

Stated another way, the present invention prefers a dispersant treat rate of about 0.06 weight percent to about 8 weight percent (preferably about 0.13 weight percent to about 4.0 weight percent) for a molybdenum treat rate of about 250 ppm to about 800 ppm

SUITABLE CODISPERSANTS

Other dispersants suitable for use as codispersants include nonmetallic additives containing nitrogen or oxygen polar groups attached to a high molecular weight hydrocarbon chain. The hydrocarbon chain provides solubility in the hydrocarbon base stocks. The dispersant functions to keep oil degradation products suspended in the oil. Examples of commonly used dispersants include copolymers such as polymethacrylates and styrene-maleic ester copolymers, succinimides, substituted succinamides, polyamine succinamides, polyhydroxy succinic esters, substituted Mannich bases, and substituted triazoles. Generally, the additional dispersant is present in the finished oil, in an amount of between about 0.1 and 5.0 wt %, based upon the active amount of dispersant.

DETERGENTS

The detergents are metallic additives containing charged polar groups, such as sulfonates or carboxylates, with aliphatic, cycloaliphatic, or alkylaromatic chains, and several metal ions. The detergents function by lifting deposits from the various surfaces of the engine. Examples of commonly used detergents include neutral and overbased alkali and alkaline earth metal sulfonates, neutral and overbased alkali and alkaline earth metal phenates, sulfurized phenates, overbased alkaline earth salicylates, phosphonates, thiopyrophosphonate, and thiophosphonates. Generally, the detergents are present in the finished oil between about 1.0 and 2.5 wt %, based upon active detergent amount.

ZDDP'S

ZDDP's (zinc dihydrocarbyl dithiophosphates) are suitable for use in the present invention as antiwear additives. These additives function by reacting with engine metal surfaces to form a new surface active compound which itself is worn and thus protects the original engine surfaces. Other examples of suitable anti-wear additives include tricresol phosphate, dilauryl phosphate, sulfurized terpenes and sulfurized fats. ZDDP's may also function as antioxidants. Generally, the ZDDP should be present in the finished oil between about 0.25 and 1.5 wt % based upon the active compound, or between about 1.0 and 1.5% based upon the active compound. When used, it is desirable for environmental reasons to have lower levels of ZDDP.

ANTIOXIDANTS

In oils according to the present invention, other antioxidants in addition to the zinc dihydrocarbyl dithiophosphates may be used to protect the oil from oxidative degradation. The amount of supplemental antioxidant will vary depending on the oxidative stability of the base stock. Typical treat levels in finished oils according to the present invention can vary from about 0.25 to about 2.5 wt %. The supplementary antioxidants that are generally used include hindered phenols, hindered bisphenols, sulfurized phenols, alkylated diphenylamines, sulfurized olefins, alkyl sulfides and disulfides, dialkyl dithiocarbamates, and phenothiazines.

The inclusion of molybdenum may lessen the need for these supplementary antioxidants. However, a supplementary antioxidant may be included in oils that are less oxidatively stable or in oils that are subjected to unusually severe conditions.

VISCOSITY INDEX IMPROVERS

A polymeric viscosity index improver (VII) component may be used in this invention and such component may be selected from any of the known viscosity index improvers. The function of the VII is to reduce the rate of change of viscosity with temperature, i.e. they cause minimal increase in engine oil viscosity at low temperature but considerable increase at high temperature. Examples of viscosity index improvers include polyisobutylenes, polymethacrylates, ethylene/propylene copolymers, polyacrylates, styrene/maleic ester copolymers, and hydrogenated styrene/butadiene copolymers.

ADDITIONAL COMPONENTS

In addition to the lubricant additives mentioned thus far, there is sometimes a need for other supplemental additives that perform specific functions not provided by the main components. These additional additives include, pour point depressants, corrosion inhibitors, rust inhibitors, foam inhibitors and supplemental friction modifiers.

CONCENTRATE

The compositions of the present invention may be in the form of a lubricating oil concentrate. Lubricating oil concentrates are added to a base stock during blending and manufacture to create a finished oil blend. Treat rates can vary widely, but it is preferable to have lower treat rates.

The lubricating oil concentrate will comprise a solvent and from about 2.5 to 90 weight percent (wt %) and preferably 5 to 75 wt % of the combination of the molybdenum additive and ethylene-propylene copolymeric dispersant of this invention. The solvent may be that of hydrocarbon oils, e.g., mineral lubrication oil or a synthetic oil. The ratio of molybdenum to dispersant in the concentrate composition is from about 0.02 to 0.6 parts of molybdenum per part of dispersant and preferably from about 0.04 to 0.4 parts of molybdenum for each part of the dispersant by weight.

In addition to the molybdenum and polymeric dispersant additives of this invention, the concentrate also may contain additional additives as is conventional in the art, e.g., dispersants, detergents, antioxidants, and zinc dihydrocarbyl dithiophosphates.

The molybdenum compound in this invention is, in certain circumstances, preferably substantially free of phosphorus and substantially free of active sulfur, and it may also be useful in low sulfur applications to have the molybdenum compound substantially free of sulfur whether active or otherwise.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosures of all applications, patents, and publications, cited above or below, are hereby incorporated by reference.

EXAMPLES

Frictional characteristics of inventive and comparative oil compositions are measured to further illustrate the unexpected synergistic properties of the invention.

The frictional properties of oils were measured using the High Frequency Reciprocating Rig. In this instrument 1–2 mls (milliliters) of a sample oil are placed in a temperature controlled steel pan. A steel ball attached to a moveable arm is lowered into the pan. A load of 400 g is applied to the steel ball/arm assembly. The steel ball/arm assembly is oscillated at 20 hz over a 1 mm (millimeter) path length. As the arm is oscillated, a friction coefficient is determined every 5 seconds.

The test lasts 3 minutes so approximately 30 data points are averaged to determine the friction coefficient of an oil in a given test. A reduction in the friction coefficient corresponds to improved friction properties of the oil. Duplicate tests were performed on each oil at 130° C. The average friction coefficient for each oil is listed in the examples.

In examples 1–3 the base fluid is an API Group II base stock. Group II base stocks are characterized as having a viscosity index between 80 and 120, and less than 90 weight percent saturates and/or less than 0.03 weight percent sulfur. In examples 4 and 5 the base fluid is a fully-formulated SAE 5W-30 motor oil blended with API Group II base stocks and commercially available additives including detergents, ZDDP, antioxidants, an anti-foam agent, a pour point depressant, a viscosity index improver, a friction modifier, and a diluent process oil.

Results of the tests run upon the oils according to the instant invention are easily seen in Tables I and II, and the benefits clearly viewed.

TABLE I

Frictional Properties of Blends in API Group II Basestock using the High Frequency Reciprocating Rig

| Example | WT % Active A | WT % active B | WT % active C | PPM D | Frictional Coefficient at 130° C. | % Reduction vs Example: 1A* (1B*, 1C*, 1D*) 2A* (2B, 2C, 2D) 3A* (3A, 3B, 3C) |
|---|---|---|---|---|---|---|
| 1A* | 3.66 | 0 | 0 | 0 | 0.141 | 0 |
| 1B* | 3.66 | 0 | 0 | 200 | 0.146 | Increase |
| 1C* | 3.66 | 0 | 0 | 500 | 0.097 | 31 |
| 1D* | 1.22 | 0 | 0 | 200 | 0.139 | 1 |
| 2A* | 0 | 1.98 | 0 | 0 | 0.127 | 0 |
| 2B | 0 | 1.98 | 0 | 200 | 0.119 | 6 |
| 2C | 0 | 1.98 | 0 | 500 | 0.056 | 56 |
| 2D | 0 | 0.66 | 0 | 200 | 0.119 | 6 |

TABLE I-continued

Frictional Properties of Blends in API Group II Basestock using the High Frequency Reciprocating Rig

| Example | WT % Active A | WT % active B | WT % active C | PPM D | Frictional Coefficient at 130° C. | % Reduction vs Example: 1A* (1B*, 1C*, 1D*) 2A* (2B, 2C, 2D) 3A* (3A, 3B, 3C) |
|---|---|---|---|---|---|---|
| 3A* | 0 | 0 | 1.2 | 0 | 0.128 | 0 |
| 3B | 0 | 0 | 1.2 | 200 | 0.113 | 12 |
| 3C | 0 | 0 | 1.2 | 500 | 0.062 | 52 |
| 3D | 0 | 0 | 0.4 | 200 | 0.069 | 46 |

*Indicates comparative example
A is a polyisobutenyl succinimide derived from a polyisobutene having a molecular weight of approximately 1350
B is an ethylene-propylene succinimide derived from an ethylene-propylene copolymer having a Mn of about 10,000
C is a cross-linked ethylene-propylene succinimide derived from an ethylene-propylene copolymer having a Mn of about 10,000.
D is Molyvan ® 822, available from R. T. Vanderbilt.

TABLE II

Frictional Properties of Fully-Formulated SAE 5W-30 Motor Oils using the High Frequency Reciprocating Rig

| Example | WT % Active E | WT % active F | PPM G | PPM H | Frictional Coefficient at 130° C. | % Reduction vs 4A (4B, 4C) or 5A (5B, 5C) |
|---|---|---|---|---|---|---|
| 4A* | 1.92 | 0 | 0 | 0 | 0.112 | 0 |
| 4B* | 1.92 | 0 | 500 | 0 | 0.099 | 13 |
| 4C* | 1.92 | 0 | 0 | 800 | 0.064 | 43 |
| 5A* | 0 | 0.96 | 0 | 0 | 0.098 | 0 |
| 5B | 0 | 0.96 | 500 | 0 | 0.074 | 24 |
| 5C | 0 | 0.96 | 0 | 800 | 0.040 | 59 |

*indicates a Ccomparative Example.
E is a commercially available Mannich dispersant.
F is a cross-linked ethylene-propylene succinimide derived from an ethylene-propylene copolymer having a Mn of about 10,000.
G is Molyvan ® 822
H is Molyvan ® 855

The dispersant in Examples 1-A, 1-B, 1-C, and 1-D is HiTEC® 646 dispersant, manufactured by and commercially available as a nominal 61% by weight polymeric succinimide dispersant oil solution from Ethyl Corporation, Richmond, Va. A varying level of Mo-822, Molyvan® 822, a molybdenum dialkyldithiocarbamate in oil, containing 4.5–5.3% molybdenum, and between 5.0 and 7.0% sulfur, is applied in examples 1B–1D.

The dispersant in Examples 2A, 2B, 2C, and 2D is HiTEC® 1910 dispersant, manufactured and commercially available as a nominal 33% by weight oil solution of an ethylene-propylene polymeric dispersant from Ethyl Corporation, Richmond, Va.

The dispersant in Examples 3A, 3B, 3C, and 3D is a cross linked low molecular weight ethylene-propylene succinic anhydride dispersant (XLEPSAD), nominally 20% active. It is similar to the dispersant utilized in examples 2, modified in that when the polymer is aminated, some of the n-phenyl phenylene diamine is replaced with a multifunctional polyamine.

The dispersant used in Examples 4A, 4B, and 4C is HiTEC® 7049 dispersant, available as a nominal 40% by weight oil solution Mannich dispersant commercially from Ethyl Corporation, Richmond.

It can be seen from Tables I and II that an improvement in frictional properties (lower coefficients of friction) result when polymeric ethylene-propylene dispersants are combined with molybdenum-based friction modifiers. In Tables I and II, H-646 is a polymeric succinimide dispersant, H-7049 is a Mannich dispersant, H-1910 is an EP polymeric dispersant, XLEPSAD is a cross linked EP polymeric dispersant, Mo822 is a commercially available molybdenum dithiocarbamate friction modifier and Mo855 is a sulfur free and phosphorus free molybdenum friction modifier. Both Mo822 and Mo855 are reported to contain between 7 and 8% molybdenum.

The preceding examples can be repeated with similar success by substituting the generically or specifically described components and/or operating conditions of this invention for those used in the preceding examples.

From the foregoing description, one skilled in the art can easily ascertain the essential characteristics of this invention and, without departing from the spirit and scope thereof, can make various changes and modifications to the invention to adapt it to various usages and conditions.

What is claimed is:

1. A lubricating oil composition comprising:

a) an oil of lubricating viscosity;

b) an oil-soluble molybdenum-containing compound selected from the group consisting of molybdenum dialkyl dithiocarbamate and organo molybdate; and c) at least one polymeric ethylene-propylene succinimide dispersant having a molecular weight of about 10,000.

2. A lubricating oil composition as claimed in claim 1, wherein said molybdenum-containing compound is substantially free of active sulfur and substantially free of phosphorus.

3. A lubricating oil composition as claimed in claim 1, wherein the ratio of said molybdenum-containing compound, based on active molybdenum, to the dispersant, based on active dispersant, is from about 0.01 to about 0.40 parts by weight of molybdenum per part of dispersant.

4. A lubricating oil composition as claimed in claim 1, wherein the ratio of said molybdenum-containing compound, based on active molybdenum, to the dispersant, based on active dispersant, is from about 0.02 to about 0.20 parts by weight of molybdenum per part of dispersant.

5. A lubricating oil composition as claimed in claim 1, wherein said molybdenum-containing compound is present in an amount of from about 50 ppm to about 1600 ppm, based on active molybdenum.

6. A lubricating oil composition as claimed in claim 1, wherein said molybdenum-containing compound is present in an amount of at least 100 ppm, based on active molybdenum.

7. A lubricating oil composition as claimed in claim 1, wherein said dispersant is present in an amount of from about 0.001 to about 5.0 weight %, based upon the active dispersant.

8. A lubricating oil composition as claimed in claim 1, wherein said dispersant is present in an amount of from about 0.005 to about 3.5 weight %, based upon the active dispersant.

9. A lubricating oil composition, comprising:

a) an oil of lubricating viscosity, said oil having greater than or equal to 90 percent saturates, less than or equal to 0.03 percent sulfur, and a viscosity index greater than or equal to 80 and less than 120;

b) a molybdenum containing compound selected from the group consisting of molybdenum dialkyl dithiocarbamate and organo molybdate in an amount of from about 200 ppm to about 800 ppm, based on active molybdenum; and c) an ethylene-propylene copolymer derived succinimide dispersant in an amount of from about 0.4 weight % to about 5.0 weight %, said copolymer having a number average molecular weight of about 10,000.

10. A lubricating oil concentrate, comprising:

a) an oil-soluble molybdenum-containing compound selected from the group consisting of molybdenum dialkyl dithiocarbamate and organo molybdate; and b) at least one polymeric ethylene-propylene succinimide dispersant having a number average molecular weight of about 10,000.

11. A concentrate as claimed in claim 10, further comprising at least one inhibitor selected from the group consisting of oxidation inhibitors, rust inhibitors, corrosion inhibitors, foam inhibitors, and copper corrosion inhibitors.

12. A motor vehicle comprising a gasoline or diesel engine, said engine being lubricated by a lubricating composition of claim 1.

13. A method of lubricating an oil-lubricated automotive engine comprising adding the lubricating oil composition of claim 1 to the lubricating oil administered to said engine.

* * * * *